US005589868A

United States Patent [19]

Schofield et al.

[11] Patent Number: 5,589,868

[45] Date of Patent: Dec. 31, 1996

[54] MULTI-HEAD WIDE-FORMAT THERMAL PLOTTER

[75] Inventors: Harry Schofield, Narragansett; Paul Caron, Tiverton; Gary Field, Portsmouth; Paul Follett, Wakefield, all of R.I.

[73] Assignee: Atlantek Inc., Wakefield, R.I.

[21] Appl. No.: 391,048

[22] Filed: Feb. 21, 1995

[51] Int. Cl.[6] ..... B41J 2/32

[52] U.S. Cl. ..... 347/171

[58] Field of Search ..... 347/171, 173; 400/82, 120.01, 120.03, 120.04

[56] References Cited

U.S. PATENT DOCUMENTS

| | | | |
|---|---|---|---|
| 4,660,052 | 4/1987 | Kaiya et al. . | |
| 4,977,410 | 12/1990 | Onuki et al. . | |
| 5,000,595 | 3/1991 | Koike et al. | 347/171 |
| 5,003,323 | 3/1991 | Onuki et al. . | |
| 5,138,336 | 8/1992 | Goto | 347/171 |
| 5,153,606 | 10/1992 | Bas | 347/171 |
| 5,229,788 | 7/1993 | Shimada et al. | 347/171 |

*Primary Examiner*—Huan H. Tran

*Attorney, Agent, or Firm*—Salter & Michaelson

[57] ABSTRACT

A wide-format thermal plotting apparatus includes a single platen roller and a plurality of thermal print heads arranged in first and second diametrically opposed rows on the platen roller, the second row having at least one more print head than the first row. More specifically, the rows are arranged in upper and lower opposed relation so that the first, or lower row supports the force applied by the upper row plus the weight of the platen roller, thereby preventing bowing thereof. A supply of print media is sequentially threaded through the first and second rows of print heads, wrapping around the platen roller so that the second or upper row is the downstream printing row. The print heads are arranged in alternating relation between the rows such that print lines of print heads in alternate rows abut or overlap each other with respect to the width of print media. Each print head is mounted for pressured engagement with the platen roller, the print heads in the second row being adjusted to have a greater engagement pressure than the print heads in the first row. The platen roller is driven so that the print media is sequentially drawn through the first and second rows of print heads. The higher number of print heads in the second, downstream row and the increased engagement pressure thereof ensures that the print media remains in contact with the platen roller during printing.

11 Claims, 2 Drawing Sheets

MULTI-HEAD WIDE-FORMAT THERMAL PLOTTER

BACKGROUND AND SUMMARY OF THE INVENTION

The instant invention relates to thermal plotting apparatus and more particularly to a wide-format thermal plotter utilizing multiple print heads to achieve a wide print web.

Multi-head, wide-format thermal plotting devices have heretofore been known in the art. In this regard, the U.S. Patents to Kaiya et al U.S. Pat. No. 4,660,052 Onuki et al U.S. Pat. No. 4,977,410 and Onuki et al U.S. Pat. No. 5,003,323 represent the closet prior art to the subject invention of which the applicant is aware. The patents to Kaiya and Onuki et al each disclose a thermal recording apparatus wherein plurality of thermal print heads (approximately 8.5 in wide) are alternately arranged in two successive rows over two parallel platen rollers. The print lines of the print heads are stitched together to provide coverage across the entire width of the print media. With appropriate data buffering a single print line having an effective width which is wider than any one individual print head can be achieved. While these apparatus are relatively effective for wide format printing, they have several drawbacks. Since the print heads are alternately arranged over two spaced parallel platen rollers, the printing apparatus must include an elongated flat print bed in order to accommodate the linear distance between the spaced platen rollers. Since each staggered row has its own platen roller, the rollers are passive rollers. Such an arrangement requires a pair of drive rollers situated downstream of the last platen roller for drawing the print media through the successive print stations. Accordingly, the print bed must further accommodate the distance between the last platen roller and the drive rollers. It can thus be seen that these types of print apparatus are extremely large occupying a significant amount of office or desk space. In order to reduce the distance between the two parallel platen rollers, the Onuki patent ('323) utilized near edge print heads mounted such that upstream and downstream near edge print lines oppose each other. However, the space saving in Onuki ('323) is minimal at best. Another significant problem is maintaining parallelism of the two platen rollers in all three axes. Slight deviations in parallelism will result in inaccurate stitching of the print lines and inaccurate paper tracking. Accordingly, the parts of these machines must be produced with very low tolerance factors in order to achieve almost perfect parallelism. Such manufacturing adds to the expense of the machines. Yet another problem is maintaining sufficient stiffness of the platen roller across the width of the print media. The structural limitations of conventional print heads require the use of relatively small-diameter platen rollers. However, it has been found that a narrow platen roller will invariably bow under pressure of the print heads when supported across a wide span. The U.S. Patent to Tzeng et al U.S. Pat. No. 4,916,463 has attempted to address this problem by supporting the platen roller with two spaced support rollers. However, this solution requires the mounting of at least four additional rollers in the prior apparatus thereby increasing cost and complexity of the apparatus.

The above-mentioned disadvantages are overcome in the instant invention by providing a wide-format thermal printing apparatus comprising a single platen roller and a plurality of thermal print heads arranged in first and second diametrically opposed rows on the platen roller. The rows of print heads in the instant device are arranged in upper and lower opposed relation so that the first, lower row supports the center of the platen roller to prevent bowing thereof. In the preferred embodiment, the first lower row includes two spaced print heads and the second upper row includes three spaced print heads. A supply of print media is sequentially threaded through the first and second rows of print heads, wrapping around the platen roller so that the second, upper row is the downstream printing row. The print heads are arranged in staggered relation between the rows such that print lines of print heads in alternate rows abut or overlap each other with respect to the width of print media. Each print head is mounted for pressured engagement with the platen roller wherein the print heads in the second row are adjusted to have a greater engagement pressure than the print heads in the first row. A back tension arm engages the print media roll for providing back tension to the media supply. The printing apparatus further includes a motor, timing belts, pulleys, and gears for driving the single platen roller. The combined print head pressures in both rows cooperate to form a nip to sequentially draw the print media through the first and second rows of print heads. It is noted however, that the engagement pressure of the first row by itself creates insufficient drawing force to overcome the media back tension. This arrangement assures a tensioning force between the first and second rows of print heads and ensures that the print media remains in contact with the platen roller at all times. The higher engagement pressure of the second row of print heads assures sufficient pulling force to pull the media through the print stations.

Accordingly, among the objects of the instant invention are: the provision of a low cost, wide-format thermal plotter; the provision of a wide-format thermal plotter which is smaller than the prior art devices; and the provision of a wide-format thermal plotter having a plurality of standard width thermal print heads mounted in two staggered rows at diametrically opposite positions on a single platen roller.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE EMBODIMENT

Figure 1:
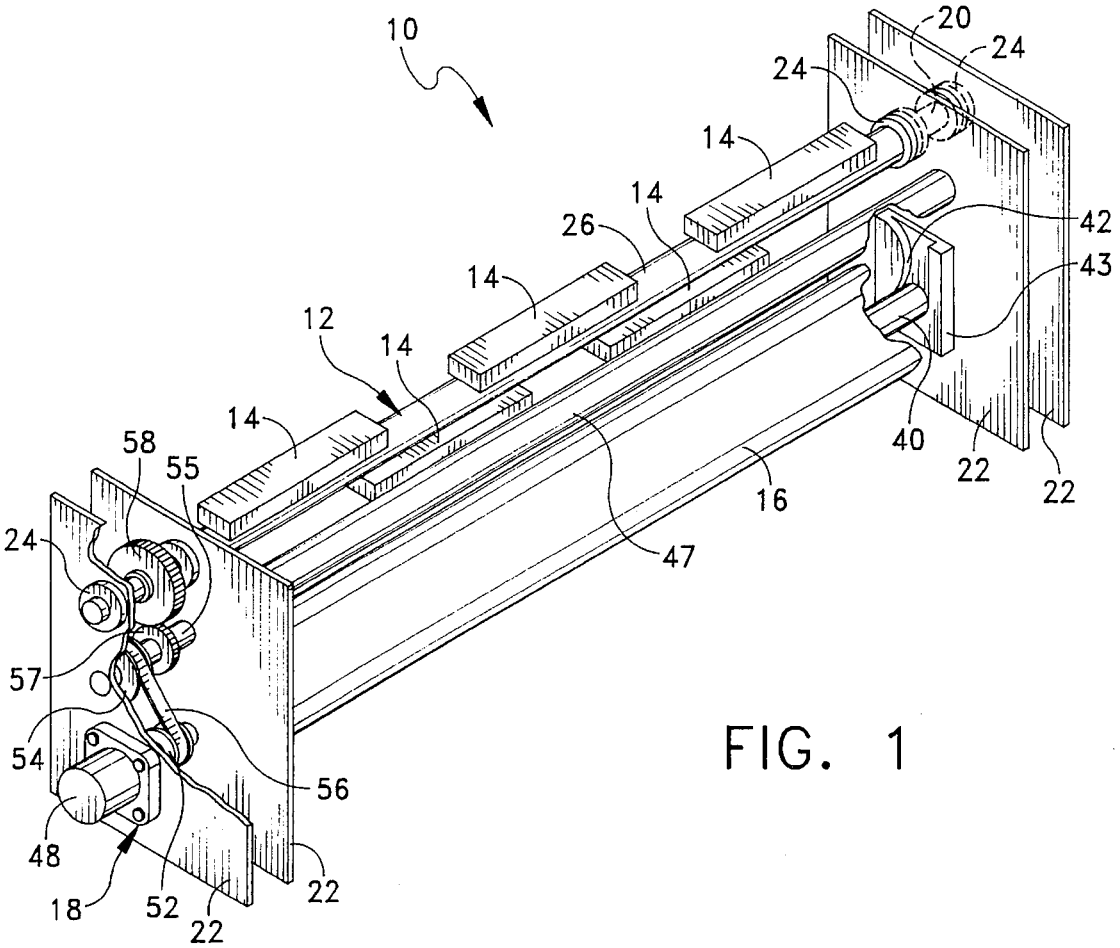
FIG. 1 is a perspective view of the instant thermal plotting device.
Figure 2:
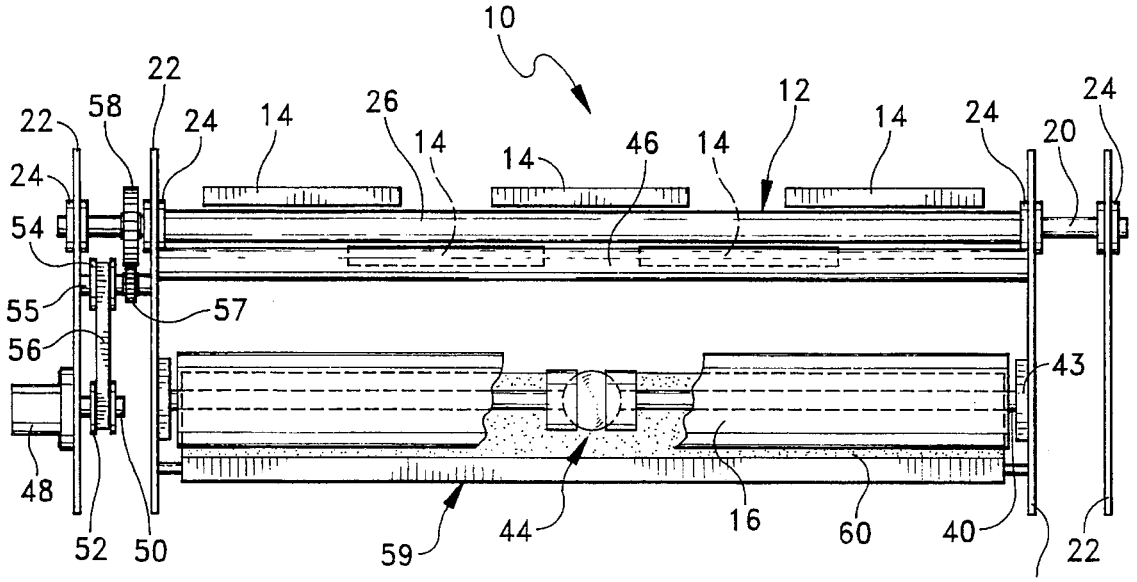
FIG. 2 is a front view thereof.
Figure 3:
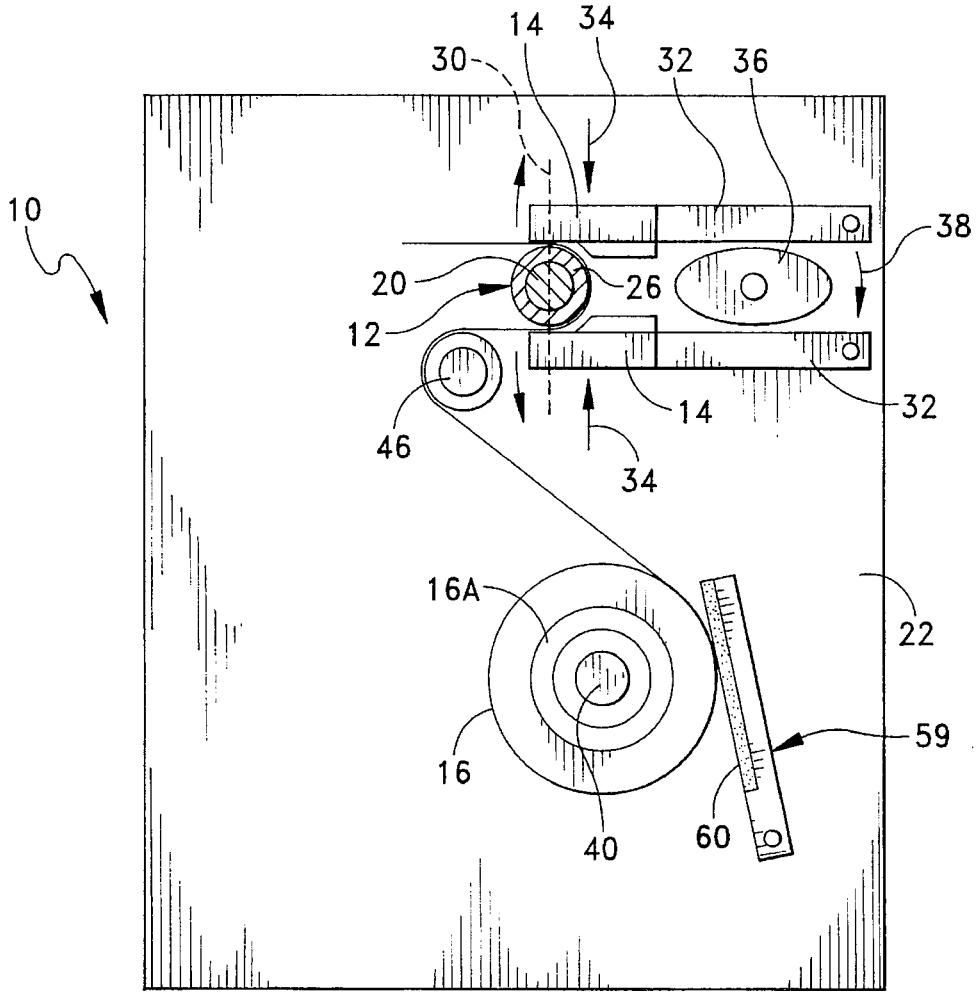
FIG. 3 is a side view thereof.
Figure 4:
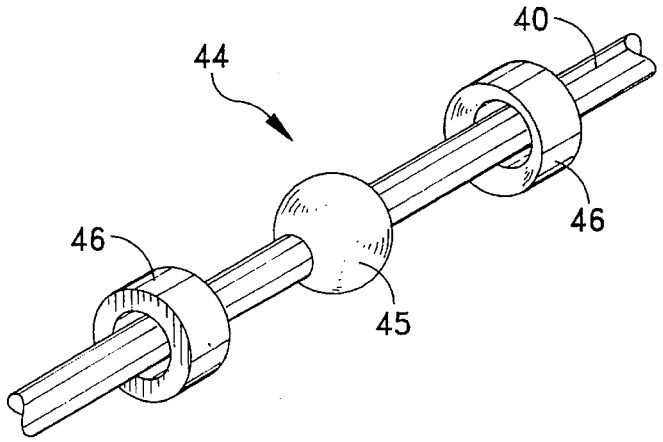
FIG. 4 is a an exploded view of the ball and socket assembly thereof.

Referring now to the drawings, the thermal printing apparatus of the instant invention is illustrated and generally indicated at 10 in FIGS. 1—3. As will hereinafter be more fully described, printing apparatus 10 utilizes a plurality of thermal print heads mounted in staggered relation to achieve a thirty-six inch wide print web.

Printing apparatus 10 comprises a single platen roller generally indicated at 12, a plurality of thermal print heads 14 arranged in first and second diametrically opposed rows on platen roller 12, a continuous web of print media generally indicated at 16, and a drive apparatus generally indicated at 18.

Thermal print heads 14 preferably comprise conventional 216 mm thermal facsimile print heads having linear print lines. Thermal facsimile heads 14 are typically manufactured on the smallest possible ceramic substrates in order to reduce manufacturing costs. This design constraint requires the use of a relatively small diameter platen roller 12, usually no greater than 0.8 inches in diameter. While small diameter platens are not normally a problem for short web widths, such as are found in conventional facsimile machines, the small diameter does pose a problem of flexing on webs of thirty-six inches in width. Any variable flexing of platen 12 will change the length of the paper path between the rows of print heads, affecting the stitch of the print lines in the two rows of print heads. In order to reduce the flexing problem, platen roller 12 includes a rigid inner shaft 20 which is rotatably supported at each end by spaced bulkheads 22. More-specifically, each end of shaft 20 passes through bearings 24 which are respectively mounted in each bulkhead 22. The spaced configuration of bulkheads 22 provides a compound support for shaft 20, thereby stiffening platen roller 12 where it would normally tend to bow. Platen roller 12 further includes a resilient outer surface 26 which allows deformation of the platen surface under pressure of the print heads 14. The deformation assures that all printing elements of the print head 14 surface make contact with the print media 16. Furthermore, the resilient surface 26 provides sufficient friction to advance the print media 16.

To further reduce flexing of platen roller 12, the first and second rows of print heads 14 are respectively mounted in lower and upper opposed relation (see FIG. 3) on platen roller 12 so that the first, lower row supports the center of platen roller 12. In this regard, print heads 14 are arranged so that the linear print lines of the opposing print heads 14 are aligned in a common vertical plane 30 (See FIG. 3). As illustrated in the drawing figures, the lower row includes two spaced print heads 14 and the upper row includes three spaced print heads 14. Print heads 14 are arranged in staggered relation between the upper and lower rows such that print lines of print heads in alternate rows abut or overlap each other with respect to the width of print media. By selectively energizing heat elements in the print heads 14, the spaced print lines can be stitched together to create an effective print web width of thirty-six inches.

Each print head 14 is mounted on a pivotable arm 32 (see FIG. 3) which is normally biased by adjustable spring means (not shown) for pressured engagement with the platen roller 12 (see arrows 34). In order to maintain a constant paper path between the lower and upper print heads 14, i.e. to prevent looping of the print media 16 around the platen roller 12, the print heads 14 in the second row are adjusted to have a greater engagement pressure than the print heads 14 in the first row. More specifically, the lower two print heads 14 are adjusted to a pressure between about 8.25 pounds and 8.75 pounds, and the upper heads 14 are adjusted to a pressure between about 8.75 pounds and about 9.25 pounds. It is important that each print head 14 in their respective row have an equal pressure so that the print media 16 doesn't skew during printing. Due to the relative position of the print heads 14 with respect to the platen support points, the net loading force from the two print heads on the bottom is offset by the three print heads on the top. Accordingly, there is minimal flexing of the platen roller 12 due to the pressured engagement of the print heads 14 thereon.

In order to lift the print heads 14 out of engagement with the platen roller 12 for loading of the print media 16, printing apparatus 10 further includes an elliptical cam 36 rotatably mounted between the pivotable arms 32 (See FIG. 3). Cam 36 is selectively rotatable (see arrow 38) to lift the print heads 14 out of pressured engagement with the platen roller 12. When rotated, the opposing ends of the cam 36 engage the pivot arms 32 and pivot them outwardly against the bias of the spring means so that the print heads 14 are in spaced relation to the platen roller 12.

The print media 16 is preferably mounted in roll form on a mandrel 40 which is rotatably supported between the inner bulkheads 22. More specifically, the ends of the mandrel 40 are freely supported in curved channels 42 formed in plates 42 affixed to the inner sides of the inner bulkheads 22. The mandrel 40 is further provided with a ball and socket assembly generally indicated at 44 for maintaining equal web tension and paper path across the width of the print media 16. Ball and socket assembly 44 comprises a spherical ball 45 mounted at the center of the mandrel 40, and two socket cups 46 which are slidably received on the mandrel 40. Ball 45 preferably has a diameter equal to an inner diameter of the core 16A of the media roll 16. Socket cups 46 have an outer diameter which is equal to the inner diameter of the core 16A and an inner diameter which is slightly larger than outer diameter of mandrel 40. Accordingly, core 16A is centrally balanced on ball 45, while socket cups 46 permit a small degree of rotation of core 16A with respect to the ball 45 as print media 16 is drawn off the roll. The freely supported mandrel 40 and socket assembly 44 ensures that the supply roll 16 assumes a parallel position as the print media is pulled off. Print media 16 is threaded through the first and second rows of print heads 14 as illustrated in FIG. 3, wrapping around the platen roller 12 so that the second or upper row is the downstream printing row.

In order to guide the print media 16 into the first row of print heads 14 in a path which is substantially tangential to the engagement point of the print heads 14 with the platen roller 12, a guide roll 46 is positioned adjacent the platen roller 12. The guide roll 46 is secured to the inner bulkheads 22 and does not rotate.

The drive apparatus 18 comprises a conventional electric motor 48 having a rotatable shaft 50. The motor 48 is mounted on the outer side of outer bulkhead 22 so that shaft 50 extends through into the space between bulkheads 22. A small pulley wheel 52 is mounted on the end of shaft 50. A larger pulley wheel 54 is mounted on a rotatable shaft 55, and a timing belt 56 extends around both pulley wheels 52, 54 for rotation of the shaft 55. A small gear 57 is also mounted on shaft 55 for rotation therewith. A larger gear 58 is mounted on platen roller 20. Gear 58 intermeshes with gear 57 for rotation of the platen roller 12. It is pointed out that gear arrangement 57, 58 is employed to mitigate any inconsistencies in the tooth to tooth length of timing belt 56. While belt 56 may have slight imperfections that may affect rotation of the platen roller 12, gears 57, 58 are machined to a much higher tolerance and effectively eliminate any imperfections which may be introduced by belt 56. Please note that imperfect rotation of platen roller 12 would cause imperfections in the stitching of print lines between the lower and upper rows of print heads. It was also found that an active platen roller 12 minimizes the deflecting load on the platen by eliminating any resultant web pulling force generated by a downstream nip pull through.

printing apparatus 10 still further includes a back-tensioning arm generally indicated at 59 for back-tensioning the print media supply 16. Arm 59 includes a mohair pad 60 which makes tangential contact with supply roll to prevent the print media from freely rolling off the roll.

In operation, both the upper and lower rows of print heads 14 cooperate to from a nip to draw the print media 16 through the apparatus. More specifically, the combined drawing force of both the upper and lower rows of print head 14 is sufficient to overcome the force exerted by the back tension arm. (Three times the media to platen coupling force of top head plus 2 times the force of bottom head is greater than the force of the back tension (3TH(F)+2BH(F)>Back Tension(F)). However, the drawing force of the bottom row by itself is insufficient to overcome the media back tension (2BH(F)<BT(F)). This arrangement assures a tensioning force between the first and second rows of print heads and ensures that the print media remains in contact with the platen roller at all times. The higher engagement pressure of the print heads 14 in the second row assures sufficient drawing force to pull the media through.

It can therefore be seen that the instant invention provides an effective thermal printing apparatus which is more cost and space efficient than any of the prior art devices. The use of a single platen roller virtually eliminates the problems associated with maintaining two spaced platens in parallel relation as found in the prior art. Furthermore, the use of a single platen roller reduces the size of the apparatus making it more compact and space efficient. The upper and lower opposed orientation of the print heads supports the elongated platen and prevents bowing of the roller. The lower engagement pressure and fewer number of print heads in the lower, or upstream, row assures slippage of the media and media contact to the platen between the two rows of printheads with the use of a modest level of back tension. For these reasons, the instant invention is believed to represent a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A thermal printing apparatus comprising:

a single platen roller, said platen roller including a shaft which is rotatably supported at each end by a pair of spaced bulkheads;

a plurality of thermal print heads arranged in first and second circumferentially spaced rows on said single platen roller, each print head being mounted for pressured engagement with said platen roller, said second row having at least one more print head than said first row, said print heads being arranged in alternating relation between said rows such that print lines of said thermal print heads in alternate rows abut each other with respect to a width of a print media; and drive apparatus for sequentially drawing said print media through said first and second rows of print heads.

2. A thermal printing apparatus comprising:

a single platen roller;

a plurality of thermal print heads arranged in first and second circumferentially spaced rows on said single platen roller, each print head being mounted for pressured engagement with said platen roller, said second row having at least one more print head than said first row, said print heads being arranged in alternating relation between said rows such that print lines of said thermal print heads in alternate rows abut each other with respect to a width of a print media; and drive apparatus for sequentially drawing said print media through said first and second rows of print heads, said print media being mounted on a roll which is rotatably supported on a mandrel, said apparatus further comprising means on said mandrel for equalizing print tension across said width of print media as said print media is drawn off said roll.

3. In the thermal printing apparatus of claim 2, said means for equalizing web tension comprising a ball centrally mounted on said mandrel and socket means mountable in a core of said roll for rotatably engaging said ball.

4. A thermal printing apparatus comprising:

a single platen roller;

a plurality of thermal print heads arranged in upper and lower diametrically opposed rows on said single platen roller, said print heads each including a print line, said print heads being arranged such that said print lines are aligned in a common vertical plane, each of said print heads engaging said single platen roller with a predetermined engagement pressure;

a continuous web of print media sequentially threaded through said first and second rows of print heads, said print heads being further arranged in alternating relation between said rows such that print lines of thermal print heads in alternate rows abut each other with respect to a width of said print media;

means for providing a back tension force on said continuous web of print media; and drive means for directly driving rotation of said platen roller wherein said first and second rows of print heads cooperate with said single platen roller to form upper and lower drawing nips directly on the surface of said single platen roller and further wherein a combined engagement pressure of said print heads in said first and second rows cooperates with said single platen roller to provide a sufficient drawing force to overcome said media back tension force and draw said print media through said first and second rows of print heads, said engagement pressure of said print heads in said first row providing insufficient drawing force to overcome said back tension force.

5. The thermal print apparatus of claim 4 wherein the engagement pressure of said print heads in said second row is greater than the engagement pressure of the print heads in said first row.

6. In the thermal printing apparatus of claim 4, said first row including two spaced print heads, said second row including three spaced print heads.

7. In the thermal printing apparatus of claim 4, said platen roller including a shaft which is rotatably supported at each end by a pair of spaced bulkheads.

8. In the thermal printing apparatus of claim 4 said print heads being movable between said position of pressured engagement with said platen roller and a second position wherein said print heads are in spaced relation with said platen roller, said thermal printing apparatus further comprising means for actuating said print heads between said positions.

9. The thermal printing apparatus of claim 4 further comprising guide apparatus adjacent said platen roller for guiding said print media along a substantially tangential path to said print line of said first row of print heads on said platen roller.

10. In the thermal printing apparatus of claim 4, said print media being mounted on a roll which is rotatably supported on a mandrel, said apparatus further comprising means on said mandrel for equalizing print tension across said width of print media as said print media is drawn off said roll.

11. In the thermal printing apparatus of claim 10, said means for equalizing web tension comprising a ball centrally mounted on said mandrel and socket means mountable in a core of said roll for rotatably engaging said ball.

* * * * *